United States Patent [19]

Matsumoto et al.

[11] 4,357,778

[45] Nov. 9, 1982

[54] TOY VEHICLE AND TRACKWAY

[75] Inventors: Hajime Matsumoto, Chiba; Toshihisa Suga, Saitama, both of Japan

[73] Assignee: Toybox Corporation, Tokyo, Japan

[21] Appl. No.: 295,109

[22] Filed: Aug. 21, 1981

[51] Int. Cl.[3] ..... A63H 11/10

[52] U.S. Cl. ..... 46/202; 104/55

[58] Field of Search ..... 46/202, 43, 1 K, 201, 46/216; 104/53, 55, 56, 63, 64, 93, 121, 118

[56] References Cited

U.S. PATENT DOCUMENTS

| | | | |
|---|---|---|---|
| 407,446 | 7/1889 | Pemberton | 46/216 X |
| 678,243 | 7/1901 | Green | 104/55 |
| 1,040,125 | 10/1912 | Bickford | 104/55 |
| 1,405,213 | 1/1922 | Hingenitz | 104/55 |
| 1,441,404 | 1/1923 | Czerny | 104/55 |
| 3,263,626 | 8/1966 | Henderson | 104/93 X |

FOREIGN PATENT DOCUMENTS

| | | | |
|---|---|---|---|
| 809517 | 7/1951 | Fed. Rep. of Germany | 46/202 |
| 985150 | 7/1951 | France | 46/202 |
| 713118 | 8/1954 | United Kingdom | 46/202 |

*Primary Examiner*—Mickey Yu

*Attorney, Agent, or Firm*—Staas & Halsey

[57] ABSTRACT

An amusement device having a toy wheeled vehicle and a trackway on which the vehicle moves. In the preferred embodiment, the wheeled vehicle has freely mounted wheels for rotation, and an upwardly extending rod which engages a lift mechanism flange. The lift mechanism raises the vehicle to a height at which gravitational force then imparts movement to the vehicle around a continuous trackway. The vehicle remains positioned on the trackway due to a trackway rail positioned between the freely mounted wheels of the vehicle. The trackway includes four different track sections which impart different movements to the vehicle as the vehicle moves along the trackway. In one track section, for example, the trackway imparts a loop-to-loop movement to the vehicle.

13 Claims, 6 Drawing Figures

TOY VEHICLE AND TRACKWAY

BACKGROUND OF THE INVENTION

This invention relates to an amusement device. More particularly, this invention relates to a free wheeling toy vehicle and a trackway cooperating to impart rapid and exciting movement to the vehicle as it moves along the trackway.

Toy vehicle and trackway devices for children are popular. These amusement devices must attract and capture the interest of the child and maintain that interest for a reasonable period of time of play. In addition, the amusement devices must by entertaining for, and operable by, children of different age levels.

SUMMARY OF THE INVENTION

Accordingly, it is a primary object of this invention to provide an amusement device of a toy wheeled vehicle and trackway wherein rapid and exciting movements are imparted to the vehicle following the trackway, thereby attracting and capturing the interest of the child and maintaining that interest for a reasonable period of time of play.

It is another object of this invention to provide a toy vehicle and trackway which is entertaining for children of different age levels.

It is another object of this invention to provide a toy vehicle and trackway which may be operated by children of different age levels.

Additional objects and advantages of the invention will be set forth in part of the description which follows, and in part will be obvious from the description, or may be learned by practice of the invention. The objects and advantages of the invention may be realized and obtained by means of the instrumentalities and combinations particularly pointed out in the appended claims.

To achieve the foregoing objects and in accordance with the purpose of the invention, as embodied and broadly described herein, the amusement device comprises a toy wheeled vehicle and a trackway having different track sections on which the vehicle moves, wherein the cooperation of the vehicle and trackway sections imparts various rapid and exciting movements to the vehicle as it moves along the relatively compact and substantially vertically oriented trackway.

In the preferred embodiment of the amusement device, a relatively compact trackway having track sections oriented in both the horizontal and vertical planes is provided. The trackway is made up of a continuous track having a continuous rail running therealong. A toy vehicle is moveably supported on the rail by upper wheels of the vehicle which rest on the upper surface of the trackway rail and lower support wheels of the vehicle which rest on the under surface of the trackway rail. A lift mechanism employs two pulleys connected by a continuous belt having several separate flanges, i.e., belt flanges. The continuous belt is rotated to allow the belt flanges to engage a rod and crossbar combination extending from the top of a toy vehicle. The flange engages the vehicle at the bottom of the lift mechanism and raise the vehicle to the top of the mechanism while it is moving along the trackway.

Once the vehicle has been raised to the curved track section above the top of the lift mechanism, gravitational force causes the vehicle to leave the belt flanges on the lift mechanism belt. The descending trackway section the vehicle then follows is not parellel to the belt so that the descending vehicle is no longer in the path of travel of the belt flanges. In further travelling along the continuous trackway by gravitational forces, the toy vehicle moves through a vertically oriented loop-to-loop at the end of the first track section, a sloping horizontal elliptical trackway section, a vertical loop-to-loop trackway section, and a sloping S-turn trackway section. At the end of the S-turn trackway section, the vehicle returns to the base of the left mechanism and is again engaged by the lift mechanism to be raised along the trackway to the top of the lift mechanism to repeat the movement already discussed above.

It is further preferred that more than one vehicle travel the trackway at one time.

It is further preferred that each vehicle used on the trackway comprise only one car.

Finally, it is preferred that various attractive decorations be placed on the device or vehicles, e.g., pictures on the pulleys, a banner across the top of the trackway, or stripes on the vehicle.

BRIEF DESCRIPTION OF THE DRAWINGS

The accompanying drawings, which are incorporated in and constitute a part of this specification, illustrate an embodiment of the invention and, together with the description, serve to explain the principles of the invention.

DETAILED DESCRIPTION OF THE PREFERRED EMBODIMENT

Figure 1:
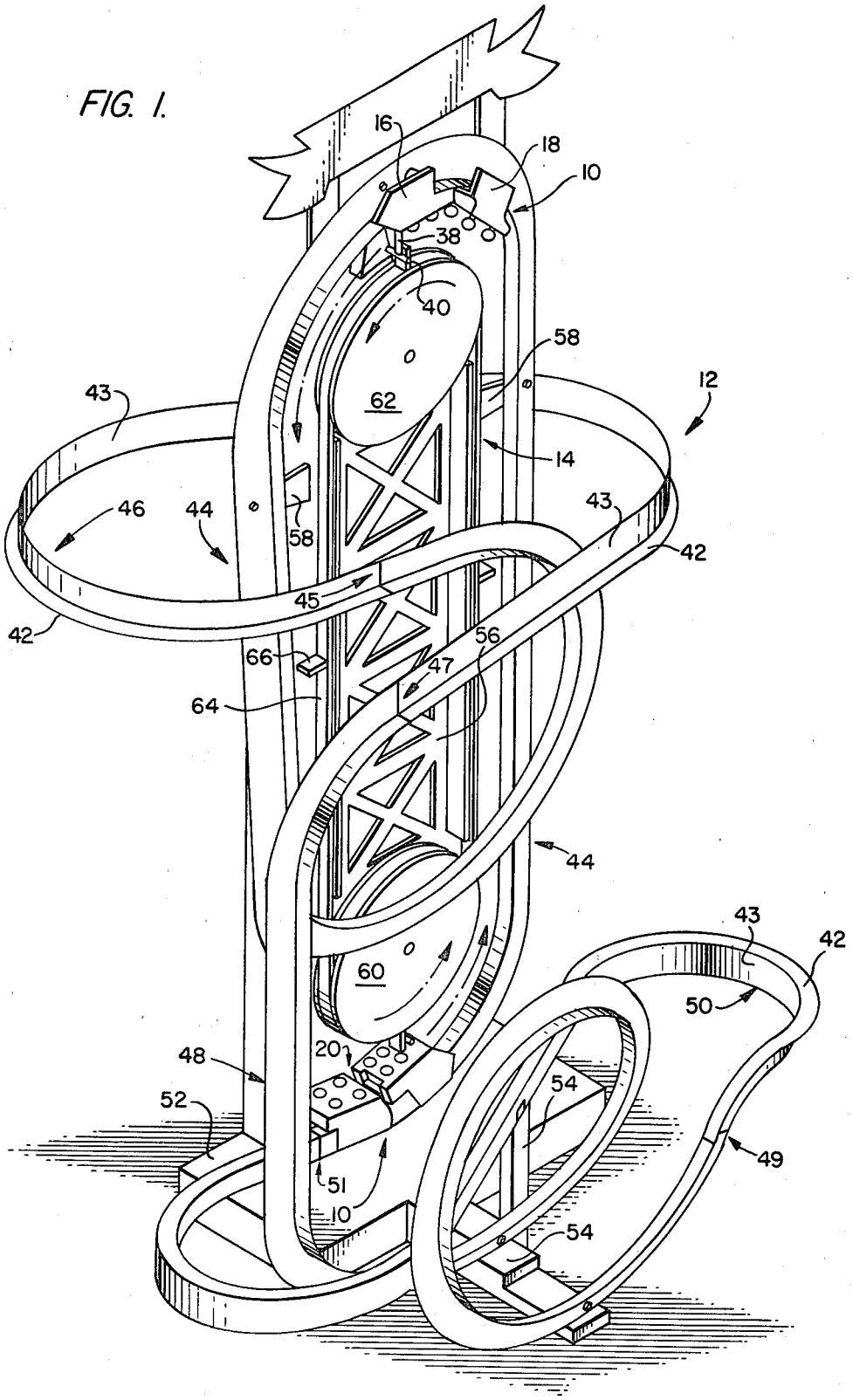
FIG. 1 is a perspective view of a preferred embodiment of the toy vehicle and continuous trackway in accordance with the invention, generally illustrating the different trackway sections and trackway rail along which the vehicle moves.

Reference will now be made in detail to the present preferred embodiment of the invention, an example of which is illustrated in the accompanying drawings.

In accordance with the invention, the amusement device comprises a toy vehicle and a trackway along which the vehicle moves. As embodied and shown in FIG. 1, the reference numeral 10 designates the toy vehicle and the reference numeral 12 designates the trackway. The reference numeral 14 designates the lift mechanism.

Figure 5:
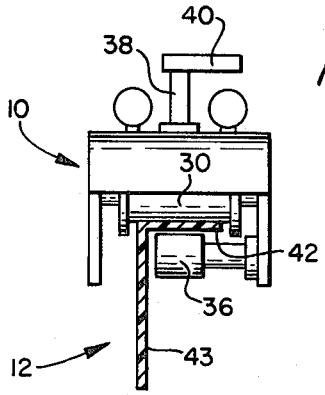
FIG. 5 is a rear plan view of the toy wheeled vehicle shown in FIG. 1, illustrating in particular the freely mounted upper wheels and lower support wheels positioned about the trackway rail, and the upwardly extending rod and crossbar combination extending from the upper surface of the vehicle.
Figure 6:
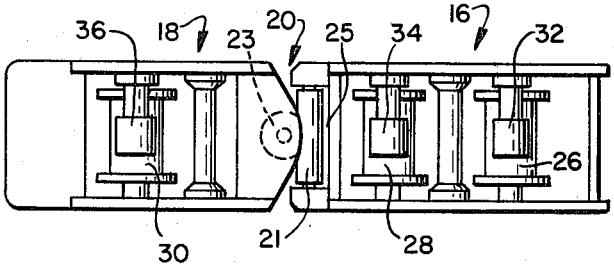
FIG. 6 is a bottom plan view of the toy wheeled vehicle shown in FIG. 1, illustrating in particular the hinge connecting the two cars of the vehicle, and the freely mounted upper wheels and freely mounted lower support wheels.

The toy vehicle 10, as best seen in FIGS. 1, 5, and 6, is provided with a front car 16 and a rear car 18. Connecting the two cars of the toy vehicle is a hinge 20 allowing each car to negotiate the curved trackway independently. Hinge 20 is formed by cylinder 21, which is rotatably mounted on front car 16, and cylinder 23, which is rotatably mounted on rear car 18, with its axis of rotation being substantially perpendicular to the axis of rotation of cylinder 21 when the two vehicles are moving in a straight line. Cylinders 21 and 23 are loosely joined by a pin 25 to permit cylinders 21 and 23 to pivot with respect to each other. Preferably upper front wheels 26, upper middle wheels 28, and upper rear wheels 30, are unitary, spool shaped elements rotatably mounted within the underside of the cars 16 and 18. Also rotatably mounted to the underside of the vehicle are a lower front support wheel 32, a lower middle support wheel 34, and a lower rear support wheel 36.

As best seen in FIG. 5, the toy vehicle also has one rod 38 extending upwardly from the vehicle's upper surface. At the top of this rod a cross bar 40 is positioned perpendicularly to the rod.

Referring again to FIGS. 1 and 5, the continuous trackway 12 is an L-shaped cross-section with a continuous rail 42 extending substantially perpendicularly from the continuous support portion 43 of the continuous trackway 12. The rail 42 is movably positioned between the outer flanges of the unitary, spool shaped wheels 26, 28, 30, which grip trackway 12 and lower support wheels 32, 34 and 36 of the vehicle 10 to serve to guide the vehicle 10 along the trackway 12.

The mode of attachment of the vehicle 10 to the L-shaped cross-section continuous trackway permits gravity action on a flimsy track which is both supported and joined at one leg of the "L", leaving the other leg of the "L" free to form a continuous rail for the free-wheeling vehicle.

The interaction of the rail and the wheel combination allows easy detachment of the vehicle from the trackway if the child so chooses. However, the vehicle never falls off of the trackway by itself, regardless of the direction it faces (e.g. upside down).

As can be seen in FIG. 1, the trackway 12 consists of several sections. The first track section 44, resembles an elliptical shape in the vertical plane which includes a loop-to-loop. The first track section 44 joins the second track section 46 at intersection 45. The second track section 46 resembles a sloping elliptical shape in the horizontal plane. The second track section 46 joins the third track section 48 at intersection 47. The third track section 48 is a loop-to-loop in the vertical plane. The third track section joins the fourth track section 50 at intersection 49. The fourth track section 50 is a sloping S-turn section in the vertical plane. The fourth track section joins the first track section at intersection 51.

It will be apparent to those skilled in the art that there are a number of suitable ways for joining these track sections, as by providing a tongue at the end of one track section to fit within and frictionally engage an opening provided at the end of the adjacent track section. Preferably, the tongue and groove would be made part of the support portion 43 of the continuous trackway 12.

The lift mechanism 14 includes a lift mechanism base 52. Connected to the lift mechanism base 52 are supports 54 which are further connected to track sections 48 and 50. Also included in the lift mechanism 14 is the lift mechanism tower 56. Also connected to the lift mechanism tower 56 are trackway supports 58 supporting the trackway sections 44 and 46. The lift mechanism 14 also consists of the lower pulley 60, the upper pulley 62, and the continuous belt 64 connecting the two pulleys. Located on the continuous belt 64 are belt flanges 66 uniformly spaced on the outside of the continuous belt 64 and positioned in the path of travel of vehicles 10 as they ascend the right vertical portion (as seen in FIG. 1) of track section 44.

Figure 4:
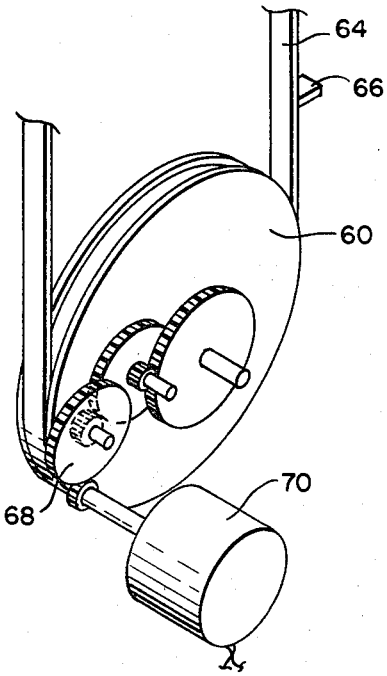
FIG. 4 is a perspective view of the electric motor driven gear mechanism which rotates the lower pulley of the lift mechanism.

As best seen in FIG. 4, to rotatably drive the plurality of gears 68 and the lower pulley 60, a miniature motor 70 of conventional configuration well-known in the art is provided at the lift mechanism base 52. This motor may be electrically powered by batteries. The motor's armature ends with the first of the plurality of gears 68 which transfers power through the rest of the plurality of and terminating with the gear attached to the axle of the lower pulley 60.

As seen in FIG. 1, the vehicle 10 is driven along the continuous trackway 12 and is imparted with different movements due to the intercooperation of the vehicle 10, the lift mechanism 14, and the various track sections of the trackway 12. For purposes of describing the preferred embodiment of the amusement device and its operation, the toy vehicle located at the lift mechanism base 52 as shown in FIG. 1 will be considered as the beginning portion of the trackway 12 for the movement of the vehicle 10.

Figure 2:
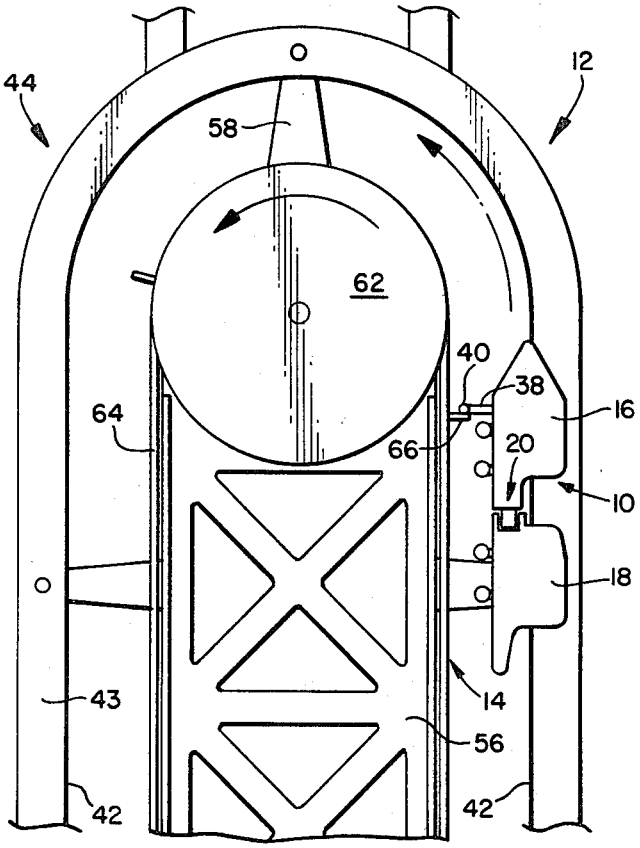
FIG. 2 is a fragmented front view of the top portion of the lift mechanism tower shown in FIG. 1, illustrating in particular the continuous belt connecting the pulleys, the upper pulley, and the interaction of the belt flange and the upwardly extending rod and cross bar combination of the toy wheeled vehicle.

When the motor 70 of the lift mechanism 14 is activated, the vehicle 10 having an upwardly extending rod 38 and cross bar 40 is engaged at the rod and cross bar combination by one of the belt flanges 66 of the continuous belt 64 of the lift mechanism 14. The vehicle 10 is moved vertically by the continuous belt 64 as the vehicle ascends the track section 44. As illustrated in FIG. 2, the vehicle is moved through the curved uppermost portion of track section 44 by the continuous belt 64 of the lift mechanism 14 until gravity cause the vehicle 10 to move freely on the descending portion of track section 44.

Figure 3:
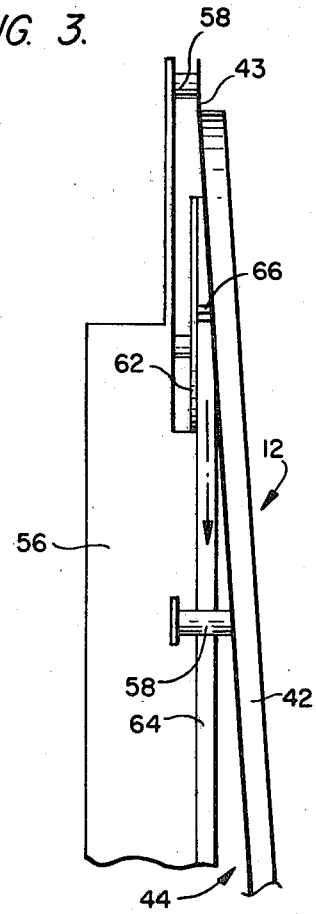
FIG. 3 is a side view of the top portion of the lift mechanism shown in FIG. 1, illustrating in particular the continuous belt connecting the two pulleys, the trackway rail, and the trackway supports located upon the lift mechanism tower.

As illustrated in FIG. 3, the descending portion of the uppermost track section 44 curves outwardly and accordingly guides the coasting vehicle 18 out of engagement with belt flanges 66 after vehicle 10 passes the summit of trackway 12. The descending track is not parallel to the belt to keep the vehicle from hitting the belt flange as the vehicle descends track section 44. It will be apparent that gravity causes the vehicle 10 to move freely on the descending portion and through the loop-to-loop of trackway section 44.

As the vehicle 10 leaves track section 44, it crosses intersection 45 and enters the connected track section 46. Movement of the vehicle along track section 46 is again provided by coasting, since the wheels 26, 28, 30, 32, 34, and 36 are freely mounted for rotation. As best shown in FIG. 1, the second track section 46 comprises a sloping elliptically shaped curve substantially in the horizontal plane including a loop-to-loop.

As the vehicle 10 coasts through track section 46, it crosses intersection 47 and enters the connected track section 48, which is provided with a loop-to-loop in the vertical plane.

After the vehicle 10 reaches the end of the loop-to-loop section 48, it coasts across intersection 49 and enters track section 50 comprising a sloping S-shaped configuration to impart an S-shaped movement of the vehicle along the track section.

It will be apparent from FIG. 1 that the vehicle 10, after coasting through track section 50, crosses intersection 51 and returns to the beginning portion of the continuous trackway 12 at the base of the lift mechanism for further movement along the trackway 12 in the manner previously described.

In view of the foregoing written description of the preferred embodiment and accompanying drawings, it is seen that the vehicle 20 is imparted with various rapid and exciting movements such as upside down, climbing and descending, as it travels along the continuous trackway made up of the various track sections 44, 46, 48 and 50. It will be apparent, however, to those skilled in the art that modifications and variations could be made in the vehicle and trackway in accordance with the teachings of the invention without departing from the spirit or scope of the invention. Thus, it is intended that the present invention cover the modifications and variations of this invention within the scope of the appended claims and their equivalents.

I claim:

1. An amusement device, comprising:

a support;

first and second pulleys rotatably mounted on said support at spaced apart positions and lying substantially in a first plane, the axes of the pulleys lying substantially in a second plane which is perpendicular to the first plane, the first pulley being positioned above the second pulley;

a belt stretched between said first and second pulleys to provide a first substantially straight belt segment and a second substantially straight belt segment;

means mounted on said support for moving said belt;

a continuous trackway mounted on said support, said trackway having a first substantially straight portion spaced apart from the first belt segment, said first straight portion lying substantially in a plane which is parallel to said first plane and also lying substantially in a plane which is parallel to said second plane, having a second substantially straight portion spaced apart from the second belt segment, said second straight portion lying substantially in a plane which intersects said first plane at an acute angle and also lying substantially in a plane parallel to said second plane, having a third portion connecting the upper ends of the first and second portions and arching over said first pulley, and having a fourth portion connecting the lower ends of said first and second portions;

a vehicle provided with means for attaching said vehicle to said trackway for coasting movement therealong; and at least one flange projecting from said belt to engage said vehicle when said vehicle is positioned on the first portion of said trackway, said vehicle being lifted by said at least one flange when said vehicle is positioned on said first portion of said trackway and being released for coasting movement after said vehicle arches over said first pulley.

2. The device of claim 1, wherein said trackway has a generally L-shaped cross-section having a continuous rail portion for supporting and guiding said toy vehicle and extending substantially perpendicularly from a support portion of the trackway, the rail portion of the first, second, and third portions of the trackway being closer to the belt than the support portions thereof and being generally parallel to the belt.

3. The device of claim 2 wherein said toy vehicle comprises at least one downwardly facing wheel element positioned on one side of said rail portion, said at least one downwardly facing wheel element having a generally spool-shaped configuration with two flanges positioned to extend past either edge of said rail portion, and at least one upwardly facing support wheel element positioned on the other side of said rail portion.

4. The device of claims 1, 2, or 3, wherein said fourth portion of the trackway comprises track imparting a generally loop-to-loop movement in a substantially vertical plane to a toy vehicle travelling upon the trackway.

5. The device of claim 4, wherein said fourth portion of the trackway further comprises track imparting a generally elliptical movement in a substantially horizontal plane to a toy vehicle travelling upon the trackway.

6. The device of claim 5, wherein said fourth portion of the trackway further comprises track imparting a generally loop-to-loop movement in a substantially vertical plane to a toy vehicle travelling upon the trackway.

7. The device of claim 6, wherein said fourth portion of the trackway further comprises track imparting a generally S-turn movement in a substantially horizontal plane to a toy vehicle travelling upon the trackway.

8. The device of claim 1, 2, or 3, wherein the vehicle comprises two cars connected by a hinge, said hinge being formed by a cylinder rotatably mounted on one car, joined by a pin to another cylinder rotatably mounted on another car, with the axis of rotation of either cylinder being substantially perpendicular to the axis of rotation of the other cylinder when the two cars are moving in a straight line, said pin permitting the cylinders to pivot with respect to each other.

9. The device of claim 1 or 2, wherein the first and second pulleys have substantially the same diameters and wherein the distance between the belt and the first, second, and third portions of the trackway is less than the diameter of the pulleys.

10. The device of claim 9, wherein the first belt segment, the second belt segment, and the first portion of the trackway are disposed substantially vertically, the third portion of the trackway being disposed at an acute angle to the vertical.

11. The device of claim 10, wherein the third portion of the trackway comprises a substantially circular arc of greater than 90° lying substantially in a plane parallel to said first plane.

12. The device of claim 11, wherein the first and second portions of the trackway are each longer than one third of the length of the substantially straight belt segments.

13. The device of claim 12, wherein there are a plurality of vehicles provided with means for attaching said vehicles to said trackway for coasting movement therealong, each vehicle comprising two cars connected by a hinge, said hinge being formed by a cylinder rotatably mounted on one car, joined by a pin to another cylinder rotatably mounted on another car, with the axis of rotation of either cylinder being substantially perpendicular to the axis of rotation of the other cylinder when the two cars are moving in a straight line, said pin permitting the cylinders to pivot with respect to each other.

* * * * *